US011035389B2

(12) United States Patent
Yuan et al.

(10) Patent No.: US 11,035,389 B2
(45) Date of Patent: Jun. 15, 2021

(54) DRIFT COMPENSATION SYSTEM FOR DRIFT RELATED TO DAMPING OF MASS-INDUCED VIBRATION IN MACHINES

(71) Applicant: EATON INTELLIGENT POWER LIMITED, Dublin (IE)

(72) Inventors: Qinghui Yuan, Edina, MN (US); Meng Wang, Chanhassen, MN (US); Michael Rannow, Eden Prairie, MN (US); Chad Larish, Rochester, MN (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/665,535

(22) Filed: Oct. 28, 2019

(65) Prior Publication Data

US 2020/0124061 A1 Apr. 23, 2020

Related U.S. Application Data

(63) Continuation of application No. PCT/US2018/029392, filed on Apr. 25, 2018.
(Continued)

(51) Int. Cl.
*F15B 13/04* (2006.01)

(52) U.S. Cl.
CPC ..... *F15B 13/0417* (2013.01)

(58) Field of Classification Search
CPC . F15B 13/0417; F15B 21/008; E04G 21/0454
See application file for complete search history.

(56) References Cited

U.S. PATENT DOCUMENTS 5,048,296 A 9/1991 Sunamura et al.
5,230,272 A * 7/1993 Schmitz ..... G05B 19/39 91/361

(Continued)

FOREIGN PATENT DOCUMENTS

KR 10-2003-0088425 A 11/2003
WO 2014/193649 A1 12/2014

(Continued)

OTHER PUBLICATIONS

International Search Report and Written Opinion of the International Searching Authority for International Patent Application No. PCT/US2018/029392 dated Aug. 10, 2018, 16 pages.

*Primary Examiner* — Thomas E Lazo
(74) *Attorney, Agent, or Firm* — Merchant & Gould P.C.

(57) ABSTRACT

A system for compensating for drift or movement of a hydraulic actuator connected to a machine's boom or similar elongate member that is caused, at least in part, by damping of mass-induced vibration. The system comprises a processing unit and a plurality of sensors operable to collect data from a control valve connected to an actuator's load holding chamber and to calculate additional volume present therein due to vibration damping. Using the calculated additional volume, the processing unit determines a hydraulic fluid flow rate appropriate to substantially reduce or eliminate the additional volume. The processing unit combines this flow rate with the hydraulic fluid flow rate necessary to cause operation of the actuator in response to the machine's operator input, and provides signals to the control valve causing actuation of the valve to output hydraulic fluid to the actuator at a rate equal to the combined flow rates.

21 Claims, 7 Drawing Sheets

Related U.S. Application Data

(60) Provisional application No. 62/535,524, filed on Jul. 21, 2017, provisional application No. 62/491,889, filed on Apr. 28, 2017.

(56) References Cited

U.S. PATENT DOCUMENTS

| | | | | |
|---|---|---|---|---|
| 5,571,226 | A | 11/1996 | Kobayashi | |
| 5,715,865 | A | 2/1998 | Wilke | |
| 5,832,730 | A | 11/1998 | Mizui | |
| 6,202,013 | B1 | 3/2001 | Anderson | |
| 6,883,532 | B2 * | 4/2005 | Rau | B66C 13/066 137/1 |
| 7,143,682 | B2 | 12/2006 | Missing et al. | |
| 7,845,169 | B2 * | 12/2010 | Brickner | E02F 3/432 60/446 |
| 8,925,310 | B2 * | 1/2015 | Pirri | E02F 9/2207 60/469 |
| 2007/0299589 | A1 | 12/2007 | Gianoglio et al. | |
| 2008/0034957 | A1 | 2/2008 | Stephenson et al. | |
| 2008/0087163 | A1 | 4/2008 | Brickner et al. | |
| 2014/0026548 | A1 | 1/2014 | Vigholm et al. | |
| 2014/0150416 | A1 * | 6/2014 | Lee | F15B 11/006 60/327 |
| 2016/0298660 | A1 | 10/2016 | Wang et al. | |

FOREIGN PATENT DOCUMENTS

| | | | |
|---|---|---|---|
| WO | 2015/031821 | A1 | 3/2015 |
| WO | 2015/073329 | A1 | 5/2015 |
| WO | 2015/073330 | A1 | 5/2015 |
| WO | 2016/011193 | A1 | 1/2016 |

* cited by examiner

DRIFT COMPENSATION SYSTEM FOR DRIFT RELATED TO DAMPING OF MASS-INDUCED VIBRATION IN MACHINES

CROSS-REFERENCE TO RELATED APPLICATIONS

This application is a Continuation of PCT/US2018/029392, filed on Apr. 25, 2018, which claims the benefit of U.S. Patent Application Ser. No. 62/491,889, filed on Apr. 28, 2017, and claims the benefit of U.S. Patent Application Ser. No. 62/535,524, filed on Jul. 21, 2017, the disclosures of which are incorporated herein by reference in their entireties.

FIELD OF THE INVENTION

The present invention relates generally to the field of hydraulic systems and, more particularly, to systems for damping mass-induced vibration in machines.

BACKGROUND

Many of today's mobile and stationary machines include long booms or elongate members that may be extended, telescoped, raised, lowered, rotated, or otherwise moved through the operation of hydraulic systems. Examples of such machines include, but are not limited to: concrete pump trucks having articulated multi-segment booms; fire ladder trucks having extendable or telescoping multi-section ladders; fire snorkel trucks having aerial platforms attached at the ends of articulated multi-segment booms; utility company trucks having aerial work platforms connected to extendable and/or articulated multi-segment booms; and, cranes having elongate booms or extendable multi-segment booms. The hydraulic systems generally comprise a hydraulic pump, one or more linear or rotary hydraulic actuators, and a hydraulic control system including hydraulic control valves to control the flow of hydraulic fluid to and from the hydraulic actuators.

The long booms and elongate members of such machines are, typically, manufactured from high-strength materials such as steel, but often flex somewhat due at least in part to their length and being mounted in a cantilever manner. In addition, the long booms and elongate members have mass and may enter undesirable, mass-induced vibration modes in response to movement during use or external disturbances such as wind or applied loads. Various systems have been developed to reduce or eliminate the mass-induced vibration. However, while reducing or eliminating the mass-induced vibration, such systems may cause slight undesirable movement of a hydraulic actuator (referred to herein as "drift" or "drifting") connected to a boom or elongate member, thereby causing the boom or elongate member to correspondingly move and no longer be positioned as needed. Such drifting may be substantial enough in some cases to necessitate re-positioning of the boom or elongate member by a machine operator.

Therefore, there is a need in the industry for a system, including apparatuses and methods, for compensating for drift in the position of a hydraulic actuator of a machine with which damping of mass-induced vibration is used, and that addresses this and other problems, issues, deficiencies, or shortcomings.

SUMMARY

Broadly described, the present invention comprises a system, including apparatuses and methods, for compensating for movement or drift of the piston of a hydraulic actuator of a machine (and corresponding movement or drift of a machine member whose position is controlled by such hydraulic actuator) resulting, at least in part, from damping of mass-induced vibration. In one inventive aspect, the system compensates for drift due to damping of mass-induced vibration by reducing or eliminating additional volume present in a load holding chamber of a hydraulic actuator as a result of such damping. In another inventive aspect, the system determines a flow rate of hydraulic fluid to compensate for drift based on the additional volume of a chamber of a hydraulic actuator due to damping of mass-induced vibration. In still another inventive aspect, the system determines a flow rate of hydraulic fluid to be supplied to a hydraulic actuator appropriate to cause desired movement of the hydraulic actuator and compensation for drift caused by damping of mass-induced vibration. In another inventive aspect, the system determines a flow rate of hydraulic fluid to compensate for drift due to damping of mass-induced vibration based on the difference of a measured position of a portion of a machine compared to a desired position of the portion of a machine. In another inventive aspect, the system determines a flow rate of hydraulic fluid to compensate for drift due to damping of mass-induced vibration based on the difference of a measured pressure of a chamber of a hydraulic actuator compared to a desired pressure of the chamber of a hydraulic actuator.

Other inventive aspects, advantages and benefits of the present invention may become apparent upon reading and understanding the present specification when taken in conjunction with the appended drawings.

DETAILED DESCRIPTION OF AN EXAMPLE EMBODIMENT

Figure 1:
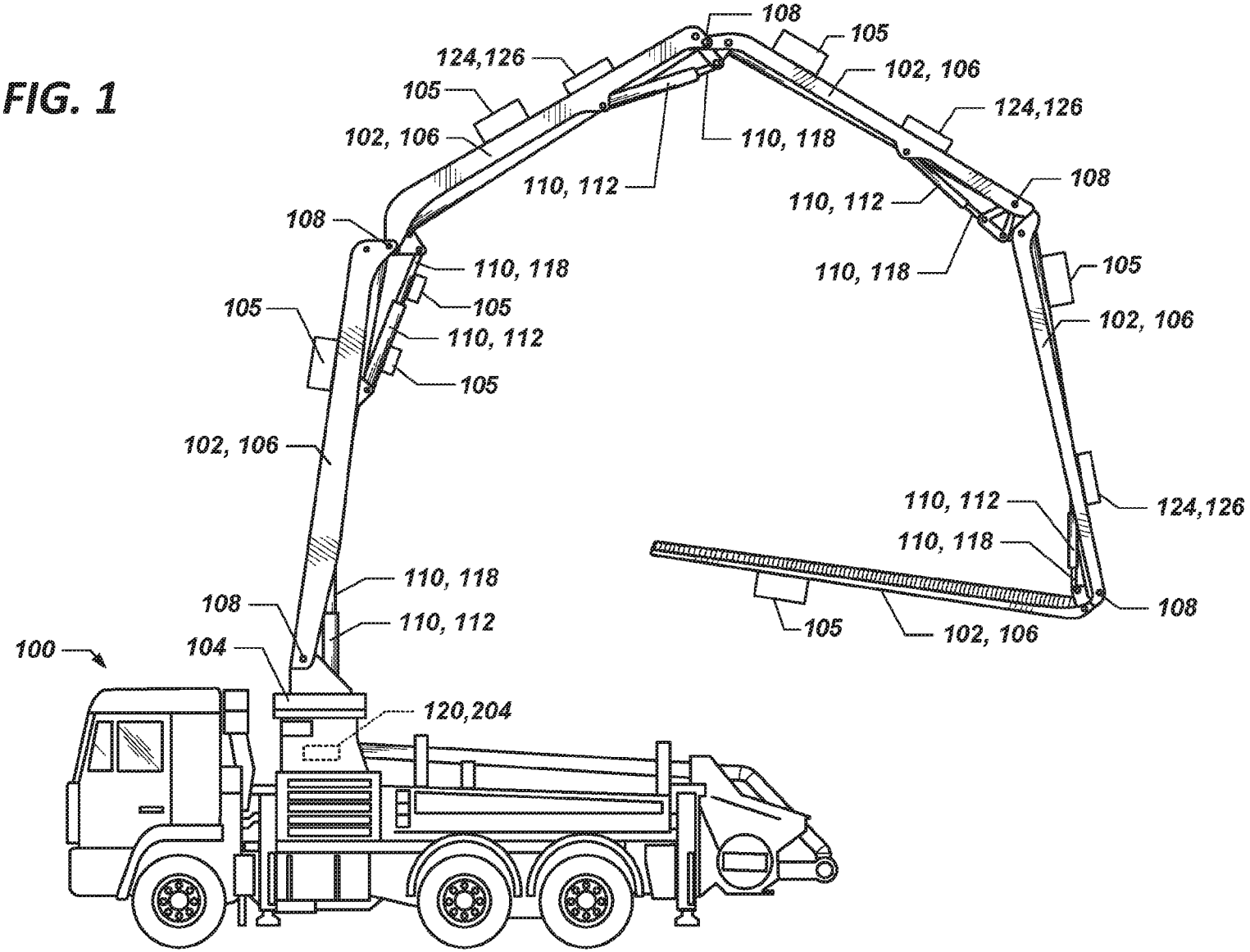
FIG. 1 displays a pictorial view of a mobile machine in the form of concrete pump truck configured with a drift compensation system in accordance with an example embodiment of the present invention and with a damping system for reducing mass-induced vibration.

Referring now to the drawings in which like elements are identified by like numerals throughout the several views, FIG. 1 displays a machine 100 configured with a drift compensation system 200, in accordance with an example embodiment of the present invention, for compensating for movement or drift in the position of a hydraulic actuator's piston 114 resulting from damping to reduce or eliminate mass-induced vibration. More specifically, in FIG. 1, the machine 100 comprises a concrete pump truck having an articulated, multi-segment boom 102 that is connected to the remainder of the concrete pump truck by a skewing mechanism 104 that enables rotation of the boom 102 about a vertical axis relative to the remainder of the concrete pump truck. The boom 102 comprises a plurality of elongate boom segments 106 that are pivotally connected by pivot pins 108 in an end-to-end manner. The machine 100 also comprises a plurality of hydraulic actuators 110 that are attached to and between each pair of pivotally connected boom segments 106. The hydraulic actuators 110 generally comprise linear hydraulic actuators operable to extend and contract, thereby causing respective pairs of pivotally connected boom segments 106 to rotate relative to one another about the pivot pin 108 coupling the boom segments 106 together. In some examples, sensors 105 (e.g., inclinometers, position sensors, angular position sensors, gyroscopes, pressure sensors, etc.) can be used to track the position of the boom 102.

Figure 2:
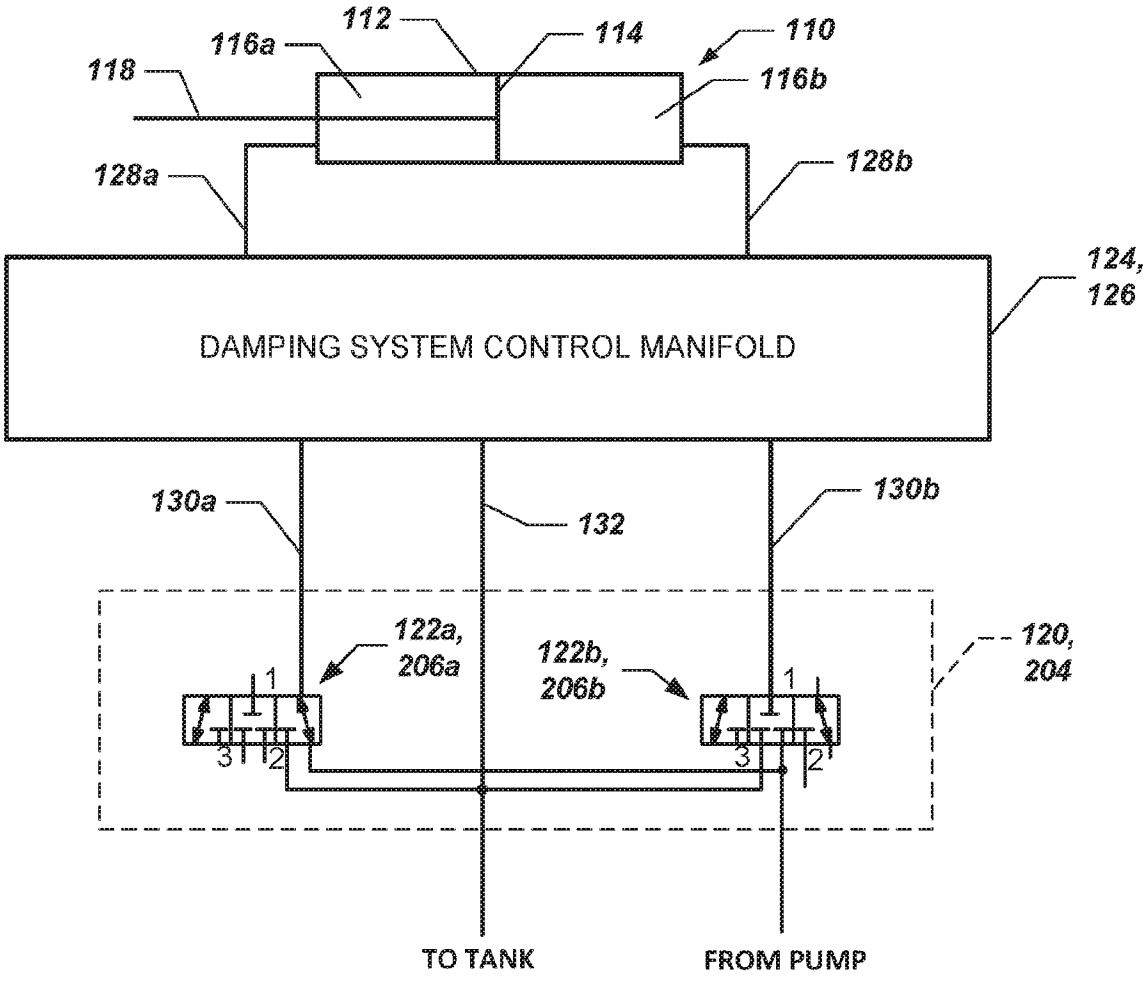
FIG. 2 displays a schematic representation of the relationship between control valves of the drift compensation system, a control manifold of the damping system for reducing mass-induced vibration, and a hydraulic actuator of the mobile machine of FIG. 1.

Each hydraulic actuator 110 has a cylinder 112 and a piston 114 located within the cylinder 112 (see FIGS. 1 and 2). The piston 114 slides within the cylinder 112 and, with the cylinder 112, defines a plurality of chambers 116 for receiving pressurized hydraulic fluid. A rod 118 attached to the piston 114 extends through one the chambers 116, through a wall of the cylinder 112, and is connected to a boom segment 106 to exert forces on the boom segment 106 causing movement of the boom segment 106. A first chamber 116*a* (also sometimes referred to herein as the "non-load holding chamber 116*a*") of the plurality of chambers 116 is located on the rod side of the actuator's piston 114 and a second chamber 116*b* (also sometimes referred to herein as the "load holding chamber 116*b*") of the plurality of chambers 116 is located on the opposite side of the actuator's piston 114.

Before proceeding further, it should be noted that while the drift compensation system 200 (sometimes referred to herein as the "system 200") is illustrated and described herein with reference to a machine 100 comprising a concrete pump truck having an articulated, multi-segment boom 102, the drift compensation system 200 may be applied to and used in connection with any machine 100 having long booms, elongate members, or other components the movement of which may induce vibration therein. It should also be noted that the drift compensation system 200 may be applied to and used in connection with mobile or stationary machines having long booms, elongate members, or other components in which mass-induced vibration may be introduced by their movement. Additionally, as used herein, the term "hydraulic system" means and includes any system commonly referred to as a hydraulic or pneumatic system, while the term "hydraulic fluid" means and includes any incompressible or compressible fluid that may be used as a working fluid in such a hydraulic or pneumatic system.

Referring back to FIGS. 1 and 2, the machine 100 additionally comprises a plurality of control valves 120 that supply hydraulic fluid to the hydraulic actuators 110. According to the example embodiment, the control valves 120 comprise solenoid-actuated, metering valves having independently operable control valve spools 122*a*, 122*b* (also sometimes referred to herein as "valve spools 122*a*, 122*b*" or "spools 122*a*, 122*b*") movable to fully open, fully closed, and intermediate positions between the fully open and fully closed positions. It should be appreciated and understood, however, that in other example embodiments, the control valves 120 may comprise other types of valves having similar capabilities and functionality.

The control valves 120 are generally arranged such that each control valve 120 is associated and operable with a particular hydraulic actuator 110. In such arrangement, the first control valve spool 122*a* of the control valve 120 supplies hydraulic fluid to the actuator's non-load holding chamber 116*a* and the second control valve spool 122*b* of the control valve 120 supplies hydraulic fluid to the actuator's load holding chamber 116*b*. The control valve spools 122*a*, 122*b* are operable to supply hydraulic fluid to each of the actuator's chambers 116*a*, 116*b* at a flow rate, $Q_{cmd}$, needed to cause operation of the hydraulic actuator 110 and movement of an associated boom segment 106 or elongate member in response to receiving a command based on the particular movement of the beam segment 106 or elongate member desired by the machine's operator. The control valve spools 122*a*, 122*b* are further operable to independently adjust the flow rate of hydraulic fluid supplied to each chamber 116*a*, 116*b* of the hydraulic actuator 110 in accordance with commands, signals, or other direction received from a damping system 124 (described below) that dampens mass-induced vibration.

When the machine's boom 102 is rotated by the skewing mechanism 104 or when connected boom segments 106 are rotated relative to one another about a respective pivot pin 108, vibration is induced in the boom 102 and boom segments 106 because the boom 102 and its boom segments 106 have mass and are being moved relative to the remainder of concrete pump truck or relative to one another. In order to dampen such mass-induced vibration, the machine 100 further includes a damping system 124 having a plurality of control manifolds 126 operable to dampen mass-induced vibration. The damping system 124 may comprise a system that reduces or eliminates mass-induced vibration detected and measured by motion sensors mounted to the machine's boom 102 or elongate member, by pressure sensors that measure the pressure of hydraulic fluid in a hydraulic actuator's chambers 116*a*, 116*b*, or by use of other devices and methods.

As illustrated in FIG. 2, each control manifold 126 is fluidically located and connected between a control valve 120 and a hydraulic actuator 110. Generally, a control manifold 126 and a hydraulic actuator 110 are associated in one-to-one correspondence such that the control manifold 126 participates in controlling the flow of pressurized hydraulic fluid delivered from a spool 122*a*, 122*b* of a control valve 120 to a chamber 116*a*, 116*b* of the hydraulic actuator 110. The control manifold 126 associated with a particular hydraulic actuator 110 is, typically, mounted near the hydraulic actuator 110 (see FIG. 1).

More particularly, each control manifold 126 is connected to the non-load holding chamber 116*a* of hydraulic cylinder 110 for the flow of hydraulic fluid therebetween by hose 128*a*, and is connected to the load holding chamber 116*b* of hydraulic cylinder 110 for the flow of hydraulic fluid therebetween by a hose 128*b*. Additionally, each control manifold 126 is connected to a control valve spool 122*a* for the flow of hydraulic fluid therebetween by hose 130*a*, and is connected to a control valve spool 122*b* for the flow of hydraulic fluid therebetween by hose 130*b*. In addition, the control manifold 126 is fluidically connected to a hydraulic fluid tank or reservoir (not shown) by a hose 132 for the flow of hydraulic fluid from the control manifold 126 to the hydraulic fluid tank. It should be appreciated and understood that although hoses 128, 130, 132 are used to connect the control manifold 126 respectively to hydraulic cylinder 110, control valves 120, and a hydraulic fluid tank or reservoir in the example embodiment described herein, the hoses 128, 130, 132 may be replaced in other example embodiments by tubes, conduits, or other apparatuses suitable for conveying or distributing hydraulic fluid.

Figure 3:
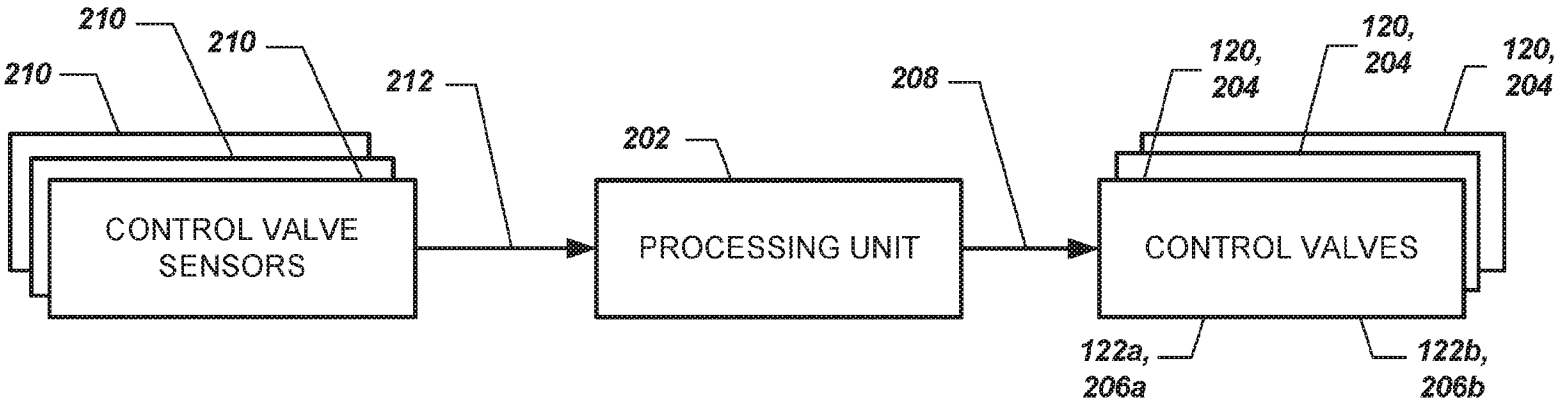
FIG. 3 displays a block diagram representation of the drift compensation system in accordance with the example embodiment of the present invention.

One example of the drift compensation system 200 is illustrated in block diagram form in FIG. 3. Briefly described above, the system 200 is operable to compensate for drift in the position of a hydraulic actuator's piston 114 (and, hence, in the position of a boom 102, boom segment 106, or elongate member controlled by the hydraulic actuator 110) due to adjustments in the flow rate of hydraulic fluid delivered to the hydraulic actuator 110 made by a co-present damping system 124 to dampen mass-induced vibration. At a high level, the system 200 provides such compensation by determining a bias volume present within the hydraulic actuator's cylinder 112 resulting from drift of the actuator's piston 114 due to dampening of mass-induced vibration by the damping system 124, calculating a flow rate of hydraulic fluid necessary to eliminate the bias volume, and adding the calculated flow rate to the flow rate of hydraulic fluid required to operate the hydraulic actuator 110 as commanded by the machine's operator. In some examples, the system 200 provides such compensation for drift in the position of a hydraulic actuator's piston 114 without the use of or need for cylinder position sensors. In other examples, drift compensation system provides such compensation for drift in the position of a hydraulic actuator's piston 114 using position sensors 105, as described below.

The system 200 comprises a processing unit 202 operable to execute a plurality of software instructions that, when executed by the processing unit 202, cause the system 200 to implement the methods and otherwise operate and have functionality as described herein. The processing unit 202 may comprise a device commonly referred to as a microprocessor, central processing unit (CPU), digital signal processor (DSP), or other similar device and may be embodied as a standalone unit or as a device shared with components of the hydraulic system with which the system 200 is employed. The processing unit 202 may include memory for storing the software instructions or the system 200 may further comprise a separate memory device for storing the software instructions that is electrically connected to the processing unit 202 for the bi-directional communication of the instructions, data, and signals therebetween.

Also, the drift compensation system 200 comprises a plurality of control valves 204 that are operable to control the flow of pressurized hydraulic fluid to control manifolds 126 and, hence, to their respective connected hydraulic actuators 110 in order to cause the hydraulic actuators 110 to extend or contract. According to the example embodiment described herein, the system's control valves 204 comprise the same control valves 120 described above such that the control valves 120 are, in a sense, shared and a part of the machine's conventional control system used to move the boom 102 or elongate member, the damping system 124 used to dampen mass-induced vibration, and the drift compensation system 200 that reduces or eliminates drift caused by operation of the damping system 124. Thus, each control valve 204 of the system 200 includes control valve spools 206*a*, 206*b* corresponding to control valve spools 122*a*, 122*b* described above.

The control valves 204 are electrically connected to processing unit 202 by respective communication links 208 for receiving control signals from processing unit 202 causing the valves' solenoids to energize or de-energize, thereby correspondingly moving the valves' spools 206*a*, 206*b* to allow full flow of hydraulic fluid through the control valves 204, no flow of hydraulic fluid through the control valves 204, or partial flow of hydraulic fluid through the control valves 204. Stated slightly differently, the flow rate of hydraulic fluid from a control valve 204 is determined at least in part by signals, data, or instructions received from processing unit 202 via communication links 208.

The drift compensation system 200 additionally comprises a plurality of control valve sensors 210 that measure various parameters related to or indicative of the operation of respective control valves 204. Such parameters include, but are not limited to, hydraulic fluid supply pressure ($P_s$), hydraulic fluid tank pressure ($P_t$), hydraulic fluid delivery pressure ($P_a$, $P_b$), hydraulic fluid temperature (T), and control valve spool displacement ($x_a$, $x_b$), where subscripts "a" and "b" correspond to actuator chambers 116*a*, 116*b* and to the first and second control valve spools 206*a*, 206*b* of a control valve 204. The control valve sensors 210 are generally attached to or at locations near respective control valves 204 as appropriate to obtain measurements of the above-identified parameters. The control valve sensors 210 are operable to obtain such measurements and to produce and output signals representative of such measurements. Communication links 212 connect the control valve sensors 210 to processing unit 202 for the communication of such output signals to processing unit 202, and may utilize wired and/or wireless communication devices and methods for such communication.

According to an example embodiment, the control valves 204, control valve sensors 210, and processing unit 202 are co-located in a single, integral unit. However, it should be appreciated and understood that, in other example embodiments, the control valves 204, control valve sensors 210, and processing unit 202 may be located in different units or locations. It should also be appreciated and understood that, in other example embodiments, the control valves 204 may comprise independent metering valves not a part of the system 200.

Figure 4:
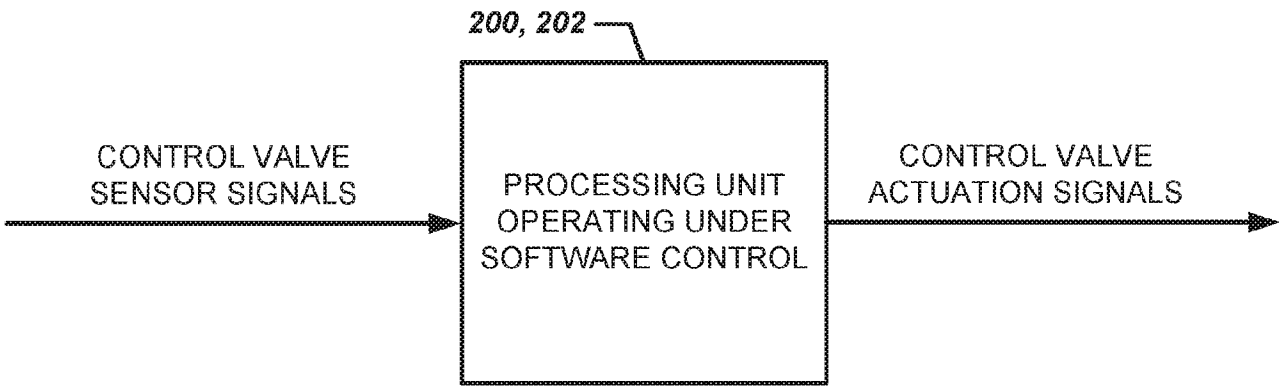
FIG. 4 displays a control diagram representation of the control methodology used by the drift compensation system in accordance with the example embodiment of the present invention.

During operation of the drift compensation system 200 and as illustrated in the control diagram of FIG. 4, the control valve sensors 210 produce electrical signals or data representative of the hydraulic fluid supply pressure ($P_s$) to control valve spools 206*a*, 206*b*, hydraulic fluid tank pressure ($P_t$), hydraulic fluid delivery pressure ($P_a$, $P_b$) at the work ports of control valve spools 206*a*, 206*b*, hydraulic fluid temperature (T), and the spool displacement ($x_a$, $x_b$) of the control valve spools 206*a*, 206*b*. The processing unit 202 receives the signals or data from control valve sensors 210 via communication links 212. Operating under the control of stored software instructions and based on the received input signals or data, the processing unit 202 generates output signals or data for delivery to the control valves 204 via communication links 208. More particularly, the processing unit 202 produces separate actuation signals or data to cause the operation of control valves 204 and spools 206*a*, 206*b* in accordance with the method described below.

Figure 5:
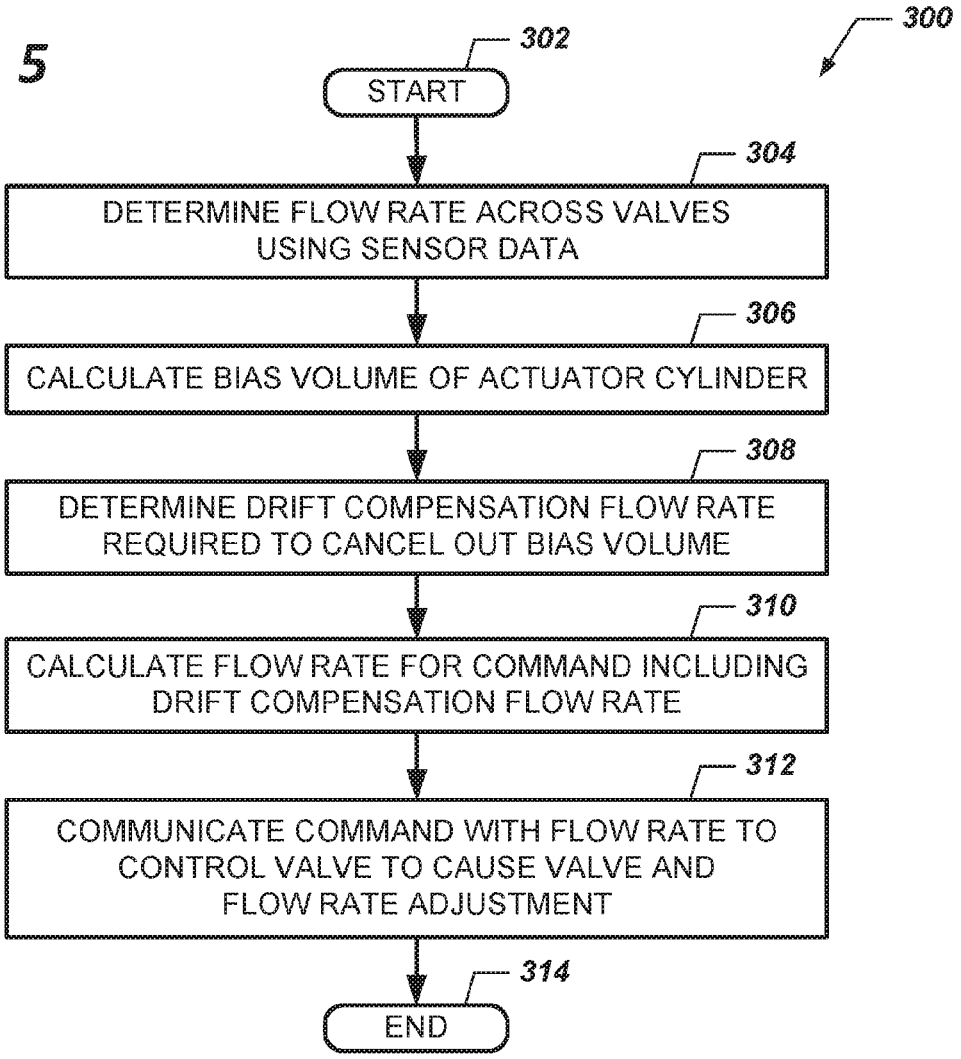
FIG. 5 displays a flowchart representation of a method for compensating for drift in accordance with the example embodiment of the present invention.

The system 200 operates in accordance with a method 300 illustrated in FIG. 5 to compensate for drift due to damping of mass-induced vibration. Operation according to method 300 starts at step 302 and proceeds to step 304 where the processing unit 202 uses signals, data, or information (including, but not limited to, hydraulic fluid temperature (T), hydraulic fluid supply pressure ($P_s$) to control valve spools 206*a*, 206*b*, hydraulic fluid delivery pressure ($P_b$) at the work port of control valve spool 206*b*, and the spool displacement ($x_b$) of control valve spool 206*b*) received from valve sensors 210 to determine the flow rate ($Q_b$) of hydraulic fluid through control valve spool 206*b* that is associated only with damping of mass-induced vibration. It should be noted that the flow rate ($Q_b$) of hydraulic fluid includes no portion associated with any purpose other than damping and does not include, for example and not limitation, a portion associated with or resulting from an operator's command to move the boom 102, boom segment 106, or elongate member controlled by the connected hydraulic actuator 110.

Next, at step 306, the processing unit 202 calculates the bias volume ($V_{drift}$) of the load holding chamber 116*b* of the connected hydraulic actuator 110 which results from damping of mass-induced vibration. The bias volume ($V_{drift}$) is related to the flow rate ($Q_b$) of hydraulic fluid through control valve spool 206*b* associated solely with damping by:

$$V_{drift}\int_{t_on}^{t_off} Q_b dt.$$

Continuing at step 308 of method 300, the processing unit 202 determines the drift compensation flow rate ($Q_{driftComp}$) required to cancel out the bias volume. The drift compensation flow rate ($Q_{driftComp}$) is given by:

$$Q_{driftComp} = -k_{drift} \cdot V_{drift}$$

where: $k_{drift}$ is a constant; and $V_{drift}$ is the bias volume.

It should be appreciated and understood that in other example embodiments, the drift compensation flow rate ($Q_{driftComp}$) required to cancel out the bias volume may be determined using other methods such as, but not limited to, proportional-integral (PI) control.

Subsequently, at step 310, the drift compensation flow rate ($Q_{driftComp}$) is added to the flow rate ($Q_{cmd}$) required to cause movement of the hydraulic actuator 110 in response to input received from the machine's operator via a joystick or other input device. The resulting flow rate ($Q_{Total}$) comprises the flow rate that control valve spool 206*b* must supply to hydraulic actuator 110 to cause movement of the machine's boom 102 or a boom segment 106 as desired by the machine's operator and to reduce or eliminate drift. Then, at step 312, signals or data representative of the resulting flow rate ($Q_{Total}$) are communicated to control valve spool 206*b*, causing the spool 206*b* to adjust and supply hydraulic fluid to hydraulic actuator 110 at a flow rate appropriate to cause desired movement of the machine's boom 102 or boom segment 106 while also reducing or eliminating drift. After communication of the resulting flow rate and adjustment of control valve spool 206*b* such that drift is substantially reduced or eliminated, the method 300 ends at step 314.

Figure 6:
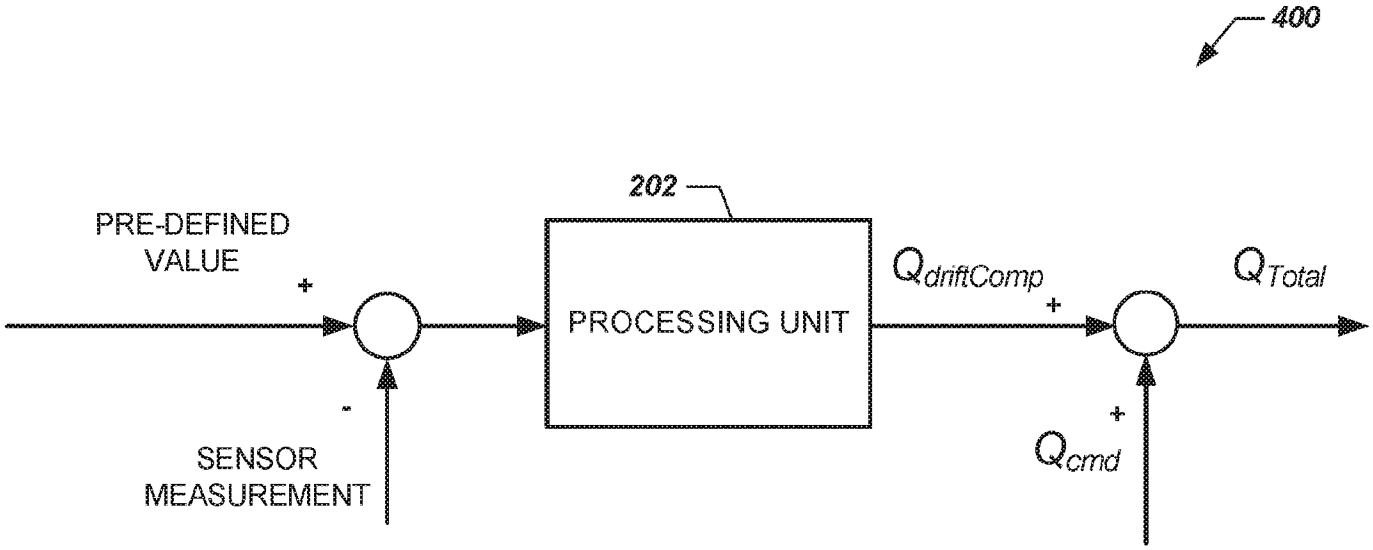
FIG. 6 displays a control diagram representation of the control methodology used by another drift compensation system in accordance with the example embodiment of the present invention.

Another example of a drift compensation system 400 is illustrated schematically in FIG. 6. Similar to the system 200 described above, system 400 is operable to compensate for drift in the position of a hydraulic actuator's piston 114 (and, hence, in the position of a boom 102, boom segment 106, or elongate member controlled by the hydraulic actuator 110) due to adjustments in the flow rate of hydraulic fluid delivered to the hydraulic actuator 110 made by a co-present damping system 124 to dampen mass-induced vibration. At a high level, in some examples, the system 400 provides such compensation by determining the position of a segment(s) 106 of the boom 102 using an external sensor(s) 105, calculating a flow rate of hydraulic fluid necessary to move the actuator 110 to eliminate the offset positioning from a predetermined position, and adding the calculated flow rate to the flow rate of hydraulic fluid required to operate the hydraulic actuator 110 as commanded by the machine's operator. In other examples, the system 400 provides such compensation by determining the difference (error) in measured hydraulic fluid pressure ($P_a$ or $P_b$ corresponding to actuator chambers 116*a*, 116*b*) and a predetermined desired pressure, calculating a flow rate of hydraulic fluid necessary to move the actuator 110 to eliminate the error in pressure values compared to the predetermined value, and adding the calculated flow rate to the flow rate of hydraulic fluid required to operate the hydraulic actuator 110 as commanded by the machine's operator.

In some examples, the system 400 is configured to use data from sensors 105 positioned on downstream boom segments 106 (i.e., toward the free end of the boom 102) to correct for motion of the upstream segment 106. In other examples, the system 400 is configured to use data from sensors 105 located on the segment 106 having the actuator 110 attached thereto (e.g., angular position sensor, gyroscope, actuator cylinder position sensor, etc.). In other examples, the system 400 is configured to use data from sensors positioned on the actuator 110 and in communication with the actuator chambers 116*a*, 116*b* (e.g., pressure sensors). Alternatively, the pressure sensors 105 may be embedded in the control valves 120.

Figure 7:
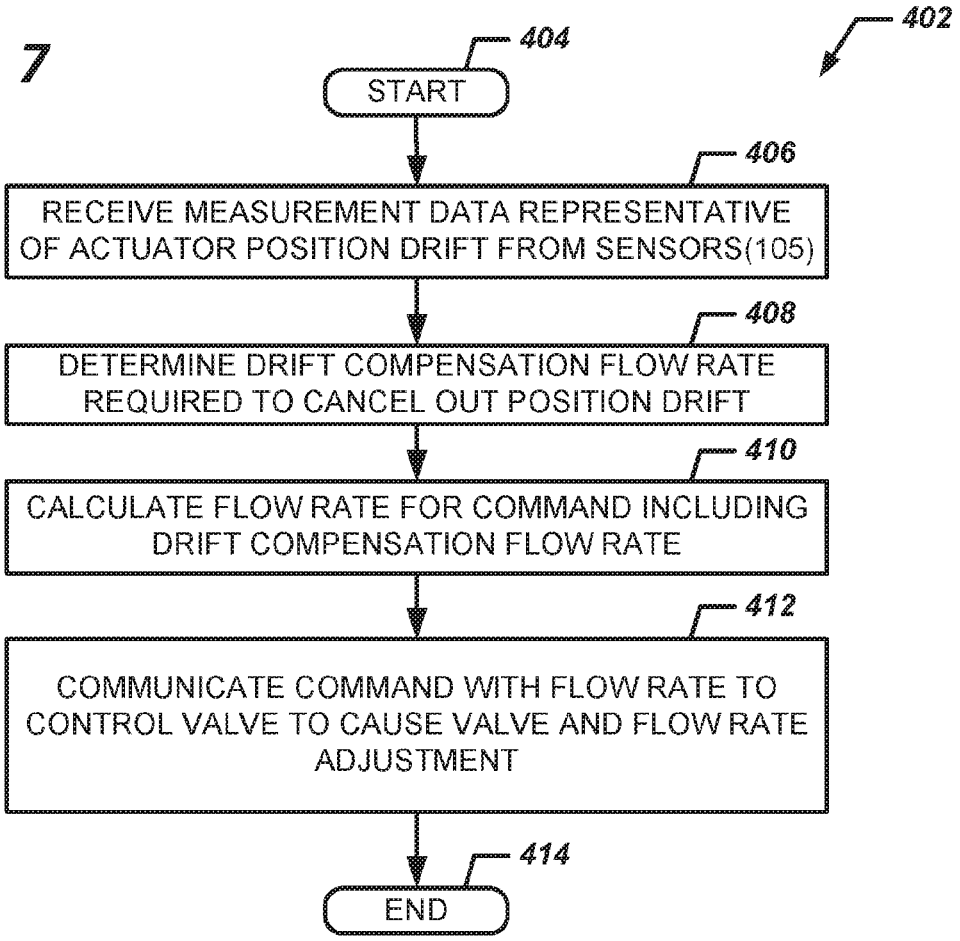
FIG. 7 displays a flowchart representation of another method for compensating for drift in accordance with the example embodiment of the present invention.

FIG. 7 shows a method 402 of operating the system 400. The method 402 starts at step 404 and proceeds to step 406 where the processing unit 202 receives signals, data, or information (including, but not limited to, linear position data, angular position data, inclinometer position data, and hydraulic fluid pressure ($P_a$, $P_b$) data) that is representative of actuator drift. Next, at step 306, the processing unit 202 determines the drift compensation flow rate ($Q_{driftComp}$) required to cancel out the positional drift of the actuator 110.

In some examples, the drift compensation flow rate ($Q_{driftComp}$) is given by:

$$Q_{driftComp} = P_{PropGAIN}(x_{desired} - x_{measured})$$

where: $P_{PropGAIN}$ is a constant;

$x_{measured}$ is a measured position by a sensor 105; and $x_{desired}$ is a predetermined desired position value set within the processor unit 202.

$P_{PropGAIN}$ can be a preset constant value assigned to compensate for drift. In some examples, $P_{PropGAIN}$ can be altered over time. In other examples, the $P_{PropGAIN}$ can be altered based on specific conditions or operation of the machine 100. In some examples, $x_{desired}$ is a measured value and can be obtained by recording a position when the damping system 124 is activated. In some examples, the $x_{desired}$ can be altered based on the preference of the operator.

In some examples, the drift compensation flow rate ($Q_{driftComp}$) is given by:

$$Q_{driftComp} = P_{PropGAIN}(P_{desired} \cdot P_{measured})$$

where: $P_{PropGAIN}$ is a constant;

$P_{measured}$ is a measured pressure in at least one actuator chamber 116*a*, 116*b*; and $P_{desired}$ is a predetermined desired pressure value set within the chosen pressure chamber 116*a*, 116*b* set within the processor unit 202.

Like $x_{desired}$ above, $P_{desired}$ can be a measured value and can be obtained by recording a pressure in a chamber 116*a*, 116*b* when the damping system 124 is activated. In some examples, the $P_{desired}$ can be altered based on the preference of the operator.

In other examples still, a proportional-integral-derivative (PID) type controller can be used in replacement to, or in conjunction with, the processing unit 202, to calculate the drift compensation flow rate ($Q_{driftComp}$). In such examples, the PID controller can calculate an error value as the difference between a measured position or pressure and a set desired position or pressure value. Once the error value is calculated, the PID controller can provide a drift compensation flow rate ($Q_{driftComp}$) based on proportional, integral, and derivative terms. When using a PID controller, the ($Q_{driftComp}$) can then be given as:

$$(Q_{driftComp})=P+I+D$$

The proportional term (P) which can account for present measured errors (i.e. current drift values), can be given as:

$$P=P_{PropGAIN}(x_{desired}-x_{measured});\text{ or}$$

$$P=P_{PropGAIN}(P_{desired}-P_{measured})$$

The integral term (I), which can account for past errors (i.e. past drift values) over time, can be given as:

$$I=I_{IntGAIN}\int_{t_on}^{t_off}(x_{desired}-x_{measured})dt;\text{ or}$$

$$I=I_{IntGAIN}\int_{t_on}^{t_off}(P_{desired}-P_{measured})dt$$

where: $I_{IntGAIN}$ is a constant.

The derivative term(D), which can account for future errors (i.e. future drift values), with respect to time, can be given as:

$$D=D_{derivGAIN}(x_{desired}-x_{measured})d(t)/dt;\text{ or}$$

$$D=D_{derivGAIN}(P_{desired}-P_{measured})d(t)/dt$$

where: $D_{derivGAIN}$ is a constant.

In some examples, $P_{PropGAIN}$, $I_{IntGAIN}$, and $D_{derivGAIN}$ are all different predetermined values. In other examples, at least one constant can be equal to another constant.

In some examples, when utilizing a pressure difference, a filter can be applied to the $P_{measured}$ values before using the values to calculate the error. In some examples, the filter can filter out high frequency feedback.

Subsequently, at step 412, the drift compensation flow rate ($Q_{driftComp}$) is added to the flow rate ($Q_{cmd}$) required to cause movement of the hydraulic actuator 110 in response to input received from the machine's operator via a joystick or other input device (also shown in FIG. 6). The resulting flow rate ($Q_{Total}$) comprises the flow rate that the control valve spool 206*b* must supply to hydraulic actuator 110 to cause movement of the machine's boom 102 or a boom segment 106 as desired by the machine's operator and to reduce or eliminate drift. Then, at step 412, signals or data representative of the resulting flow rate ($Q_{Total}$) are communicated to control valve spool 206*b*, causing the spool 206*b* to adjust and supply hydraulic fluid to the hydraulic actuator 110 at a flow rate appropriate to cause desired movement of the machine's boom 102 or boom segment 106 while also reducing or eliminating drift. After communication of the resulting flow rate and adjustment of control valve spool 206*b* such that drift is substantially reduced or eliminated, the method 402 ends at step 414.

In some examples, the systems 200 and 400 can be disabled when the absolute value of the drift error is below a certain predefined threshold to prevent conflict with the damping system 124.

Whereas the present invention has been described in detail above with respect to example embodiments thereof, it should be appreciated that variations and modifications might be effected within the spirit and scope of the present invention.

EXAMPLES

Illustrative examples of the system disclosed herein are provided below. An example of the system may include any one or more, and any combination of, the examples described below.

Example 1

In combination with, or independent thereof, any example disclosed herein, a system for compensating for drift of a hydraulic actuator connected to an elongate member of a machine, the drift resulting from damping of mass-induced vibration produced by movement of the elongate member, the system includes a control valve that is operable to control the delivery of hydraulic fluid to the hydraulic actuator. The system includes a plurality of sensors that are operable to measure one or more properties related to the flow of hydraulic fluid through the control valve and to output signals corresponding to measurements of the one or more properties. The system includes a processing unit that is operable to receive the output signals and to cause the control valve to adjust the flow rate of hydraulic fluid from the control valve to the hydraulic actuator by an amount to compensate for drift of the hydraulic actuator.

Example 2

In combination with, or independent thereof, any example disclosed herein, the processing unit is further operable to calculate the amount of additional volume in a chamber of the hydraulic actuator due to drift of the hydraulic actuator.

Example 3

In combination with, or independent thereof, any example disclosed herein, the processing unit is further operable to calculate a flow rate of hydraulic fluid that reduces the additional volume.

Example 4

In combination with, or independent thereof, any example disclosed herein, the processing unit is further operable to calculate a flow rate of hydraulic fluid that reduces the additional volume and supplies an amount of hydraulic fluid to the hydraulic actuator sufficient to cause the hydraulic actuator to operate in response to machine operator input.

Example 5

In combination with, or independent thereof, any example disclosed herein, at least one sensor of the plurality of sensors is embedded in the control valve.

Example 6

In combination with, or independent thereof, any example disclosed herein, the plurality of sensors comprise at least one pressure sensor operable to measure the pressure of hydraulic fluid.

Example 7

In combination with, or independent thereof, any example disclosed herein, the plurality of sensors comprise at least one flow rate sensor operable to measure the flow rate of hydraulic fluid.

Example 8

In combination with, or independent thereof, any example disclosed herein, the plurality of sensors comprise at least one spool displacement sensor operable to measure displacement of a spool of the control valve.

Example 9

In combination with, or independent thereof, any example disclosed herein, the control valve comprises a metering valve.

Example 10

In combination with, or independent thereof, any example disclosed herein, a method for compensating for drift of a hydraulic actuator operable to move an elongate member of a machine, the drift resulting from damping of mass-induced vibration produced by movement of the elongate member, the method including collecting data representative of properties of hydraulic fluid delivered by a control valve to the hydraulic actuator. The method includes calculating a flow rate of hydraulic fluid from the control valve to reduce drift of the hydraulic actuator. The method includes adjusting the control valve to deliver the calculated flow rate of hydraulic fluid to the hydraulic actuator.

Example 11

In combination with, or independent thereof, any example disclosed herein, the step of calculating includes a step of determining the volume within a load holding chamber of the hydraulic actuator resulting from drift due at least in part to damping of mass-induced vibration.

Example 12

In combination with, or independent thereof, any example disclosed herein, the step of determining includes a step of calculating the flow rate of hydraulic fluid from the control valve based at least in part on data representative of a property of the hydraulic fluid.

Example 13

In combination with, or independent thereof, any example disclosed herein, the property comprises the pressure of the hydraulic fluid supplied to the hydraulic actuator.

Example 14

In combination with, or independent thereof, any example disclosed herein, the property comprises the pressure of the hydraulic fluid supplied to the control valve.

Example 15

In combination with, or independent thereof, any example disclosed herein, the property comprises the temperature of the hydraulic fluid supplied to the control valve.

Example 16

In combination with, or independent thereof, any example disclosed herein, the property comprises the displacement of a spool of the control valve.

Example 17

In combination with, or independent thereof, any example disclosed herein, the method further includes a step of combining the calculated flow rate with a flow rate of hydraulic fluid sufficient to cause movement of the hydraulic actuator in response to input received from a machine operator.

Example 18

In combination with, or independent thereof, any example disclosed herein, a system for compensating for drift of a machine, the drift resulting from damping of mass-induced vibration produced by movement of an elongate member, the system including a hydraulic actuator connected to an elongate member and a control valve operable to control the delivery of hydraulic fluid to the hydraulic actuator. The system includes at least one sensor operable to measure one or more properties related to a position of at least one of the hydraulic actuator and elongate member. The sensor is operable to output signals corresponding to measurements of the one or more properties. The system includes a processing unit operable to receive the output signals and to cause the control valve to adjust the flow rate of hydraulic fluid from the control valve to the hydraulic actuator by an amount to compensate for drift of the hydraulic actuator.

Example 19

In combination with, or independent thereof, any example disclosed herein, the processing unit is a proportional-integral-derivative processing unit.

Example 20

In combination with, or independent thereof, any example disclosed herein, the sensor is at least one of an inclinometer, linear position sensor, angular position sensor, and gyroscope.

Example 21

In combination with, or independent thereof, any example disclosed herein, the sensor is a pressure sensor in communication with the hydraulic actuator.

What is claimed is:

1. A system for compensating for drift of a hydraulic actuator connected to an elongate member of a machine, the drift resulting from damping of mass-induced vibration produced by movement of the elongate member, said system comprising:

a control valve operable to control the delivery of hydraulic fluid to the hydraulic actuator;

a plurality of sensors operable to measure one or more properties related to the flow of hydraulic fluid through said control valve and to output signals corresponding to measurements of the one or more properties; and a processing unit operable to receive said output signals and to cause said control valve to adjust the flow rate of hydraulic fluid from said control valve to the hydraulic actuator by an amount to compensate for drift of the hydraulic actuator, the drift being due to adjustments in the flow rate of hydraulic fluid delivered to the hydraulic actuator by the control valve to dampen mass-induced vibration.

2. The system of claim 1, wherein said processing unit is further operable to calculate the amount of additional volume in a chamber of the hydraulic actuator due to drift of the hydraulic actuator.

3. The system of claim 2, wherein said processing unit is further operable to calculate a flow rate of hydraulic fluid that reduces said additional volume.

4. The system of claim 3, wherein said processing unit is further operable to calculate a flow rate of hydraulic fluid that reduces said additional volume and supplies an amount of hydraulic fluid to the hydraulic actuator sufficient to cause the hydraulic actuator to operate in response to machine operator input.

5. The system of claim 1, wherein at least one sensor of said plurality of sensors is embedded in said control valve.

6. The system of claim 1, wherein said plurality of sensors comprises at least one pressure sensor operable to measure the pressure of hydraulic fluid.

7. The system of claim 1, wherein said plurality of sensors comprises at least one flow rate sensor operable to measure the flow rate of hydraulic fluid.

8. The system of claim 1, wherein said plurality of sensors comprises at least one spool displacement sensor operable to measure displacement of a spool of said control valve.

9. The system of claim 1, wherein said control valve comprises a metering valve.

10. A method for compensating for drift of a hydraulic actuator operable to move an elongate member of a machine, the drift resulting from damping of mass-induced vibration produced by movement of the elongate member, said method comprising the steps of:

collecting data representative of properties of hydraulic fluid delivered by a control valve to the hydraulic actuator;

calculating a flow rate of hydraulic fluid from the control valve to reduce drift of the hydraulic actuator, the drift being due to adjustments in the flow rate of hydraulic fluid delivered to the hydraulic actuator by the control valve to dampen mass-induced vibration; and adjusting the control valve to deliver the calculated flow rate of hydraulic fluid to the hydraulic actuator.

11. The method of claim 10, wherein the step of calculating comprises a step of determining the volume within a load holding chamber of the hydraulic actuator resulting from drift due at least in part to damping of mass-induced vibration.

12. The method of claim 11, wherein the step of determining comprises a step of calculating the flow rate of hydraulic fluid from the control valve based at least in part on data representative of a property of the hydraulic fluid.

13. The method of claim 12, wherein the property comprises the pressure of the hydraulic fluid supplied to the hydraulic actuator.

14. The method of claim 12, wherein the property comprises the pressure of the hydraulic fluid supplied to the control valve.

15. The method of claim 12, wherein the property comprises the temperature of the hydraulic fluid supplied to the control valve.

16. The method of claim 12, wherein the property comprises the displacement of a spool of the control valve.

17. The method of claim 10, wherein the method further comprises a step of combining the calculated flow rate with a flow rate of hydraulic fluid sufficient to cause movement of the hydraulic actuator in response to input received from a machine operator.

18. A system for compensating for drift of a machine, the drift resulting from damping of mass-induced vibration produced by movement of an elongate member, said system comprising:

a hydraulic actuator connected to the elongate member;

a control valve operable to control the delivery of hydraulic fluid to the hydraulic actuator;

at least one sensor operable to measure one or more properties related to a position of at least one of the hydraulic actuator and elongate member, the sensor being operable to output signals corresponding to measurements of the one or more properties; and a processing unit operable to receive said output signals and to cause said control valve to adjust the flow rate of hydraulic fluid from said control valve to the hydraulic actuator by an amount to compensate for drift of the hydraulic actuator, the drift being due to adjustments in the flow rate of hydraulic fluid delivered to the hydraulic actuator by the control valve to dampen mass-induced vibration.

19. The system of claim 18, wherein said processing unit is a proportional-integral-derivative processing unit.

20. The system of claim 18, wherein the sensor is at least one of an inclinometer, linear position sensor, angular position sensor, and gyroscope.

21. The system of claim 18, wherein the sensor is a pressure sensor in communication with the hydraulic actuator.

* * * * *